US005779145A

United States Patent [19]

Zelle et al.

[11] Patent Number: 5,779,145

[45] Date of Patent: Jul. 14, 1998

[54] DEVICE FOR SECURING RAILROAD TRACKS FOR TRAIN SETS

[76] Inventors: David A. Zelle; Jill J. T. Zelle, both of 4709 Belfield Dr., Dublin, Ohio 43017

[21] Appl. No.: 744,650

[22] Filed: Nov. 6, 1996

Related U.S. Application Data

[60] Provisional application No. 60/007,280 Nov. 6, 1995.

[51] Int. Cl.[6] ..... A63H 19/30

[52] U.S. Cl. ..... 238/10 E; 238/10 C; 238/10 F

[58] Field of Search ..... 238/10 R, 10 A, 238/10 B, 10 C, 10 E, 10 F

[56] References Cited

U.S. PATENT DOCUMENTS

| | | | |
|---|---|---|---|
| 3,581,988 | 6/1971 | Kin et al. | 238/10 |
| 3,734,404 | 5/1973 | Baynes et al. | 238/10 E |
| 3,767,114 | 10/1973 | Rossi | 238/10 E |
| 4,223,834 | 9/1980 | Fecther | 238/10 E |
| 4,771,943 | 9/1988 | Cooney et al. | 238/10 E |
| 4,826,076 | 5/1989 | Hesse | 238/10 E |
| 4,898,326 | 2/1990 | Edwards et al. | 238/10 E |
| 4,951,872 | 8/1990 | Sheffield | 238/10 E |

FOREIGN PATENT DOCUMENTS

| | | | |
|---|---|---|---|
| 3402726 | 8/1985 | Germany | 238/10 E |

*Primary Examiner*—S. Joseph Morano
*Attorney, Agent, or Firm*—Standley & Gilcrest

[57] ABSTRACT

A track connector for connecting two adjoining pieces of a toy railroad track set. The track connector has arms which extend to accommodate tracks of differing size.

8 Claims, 3 Drawing Sheets

DEVICE FOR SECURING RAILROAD TRACKS FOR TRAIN SETS

This application claims the benefit of U.S. Provisional Application Ser. No. 60/007,280 filed on Nov. 6, 1995.

BACKGROUND AND SUMMARY OF THE INVENTION

The present invention relates to a track connection securing device for wooden train sets and more specifically to a track connection which snaps or slides over the outside edges of the connecting part of two adjoining tracks, the clamps being assembled onto the rails from below.

It is known that it takes great planning, patience and time to set up a workable train track layout. In addition, track designs which involve vertical lifts and multilevel tracks require support pillars at each and every track section connection, thus significantly limiting track design and providing a very unstable, virtually unusable layout. Track layouts can take hours to assemble with each support requiring minutely accurate placement and any slight deviation resulting in devastating collapse. The serviceability for children of any layout other is than a flat simple design is completely impractical.

Accordingly, it is the object of the present invention to provide a device to secure and stabilize the interlocking track connection of two tracks of a wooden train set that will overcome the above mentioned difficulties, effectively resist loosening and disconnection under even abusive conditions of operation, while being readily disconnectable by simple, deliberate manipulation.

It is another object of the present invention to provide a track connection securing device which provides vertical, longitudinal and lateral support and alignment between track sections, thus multiplying and adding complexity to track design layouts. This allows for a tremendous increase in the horizontal distance between support pillars required on viaducts and bridge spans and allows for higher vertical track designs.

It is another object of the present invention to provide a track connector having the advantageous characteristics mentioned in the preceding paragraph, which may effectively form a relatively permanent part of a track section for quick and easy detachable connection therewith to a like track section, thereby effecting substantial savings in time and greatly facilitating the assembling and disassembling procedures.

It is a more particular object of the present invention to provide a track connector of the type described which is extremely simple in construction, being advantageously fabricated of a single integral sheet of resilient material, so as to be durable and reliable throughout a long useful life, and capable of economic mass production for sale at a reasonable cost.

Other objects of the present invention will become apparent upon reading the following specification and referring to the accompanying drawings, which form a material part of this disclosure.

While the present invention is susceptible of various modifications and alternative constructions, illustrative embodiments are shown in the drawings and will hereinbelow be described in detail. It should be understood, however, that it is not the intention to limit the invention to the particular forms disclosed; on the contrary, the intention is to cover all modifications, equivalents and alternative constructions falling within the spirit and scope of the invention as expressed in the appended claims.

BRIEF DESCRIPTION OF THE DRAWINGS

Novel features and advantages of the present invention, in addition to those mentioned above, will become apparent to those skilled in the art from a reading of the following detailed description in conjunction with the accompanying drawings wherein similar reference characters refer to similar parts and in which.

DESCRIPTION OF THE PREFERRED EMBODIMENT

The preferred system herein described is not intended to be exhaustive or to limit the invention to the precise forms disclosed. They are chosen and described to explain the principles of the invention, and the application of the method to practical uses, so that others skilled in the art may practice the invention.

In accordance with one of the important aspects of the present invention provision is made for a track section having excellent strength and stiffness characteristics while also being alignable one track section to another.

Figure 1:
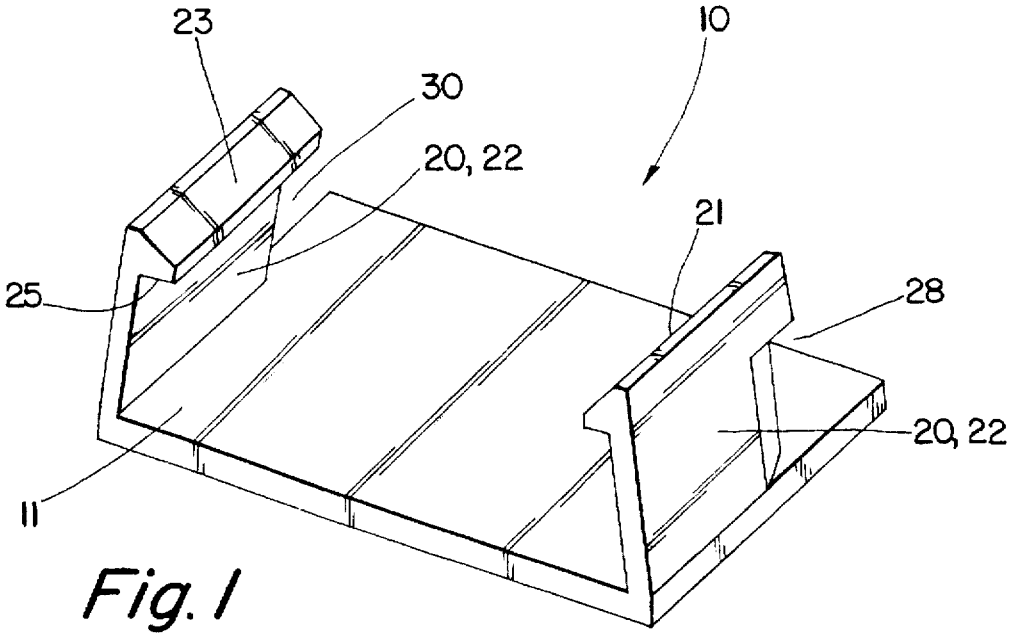
FIG. 1 is a perspective view showing a connector constructed in accordance with the teachings of the present invention, apart from the track sections proper.
Figure 2:
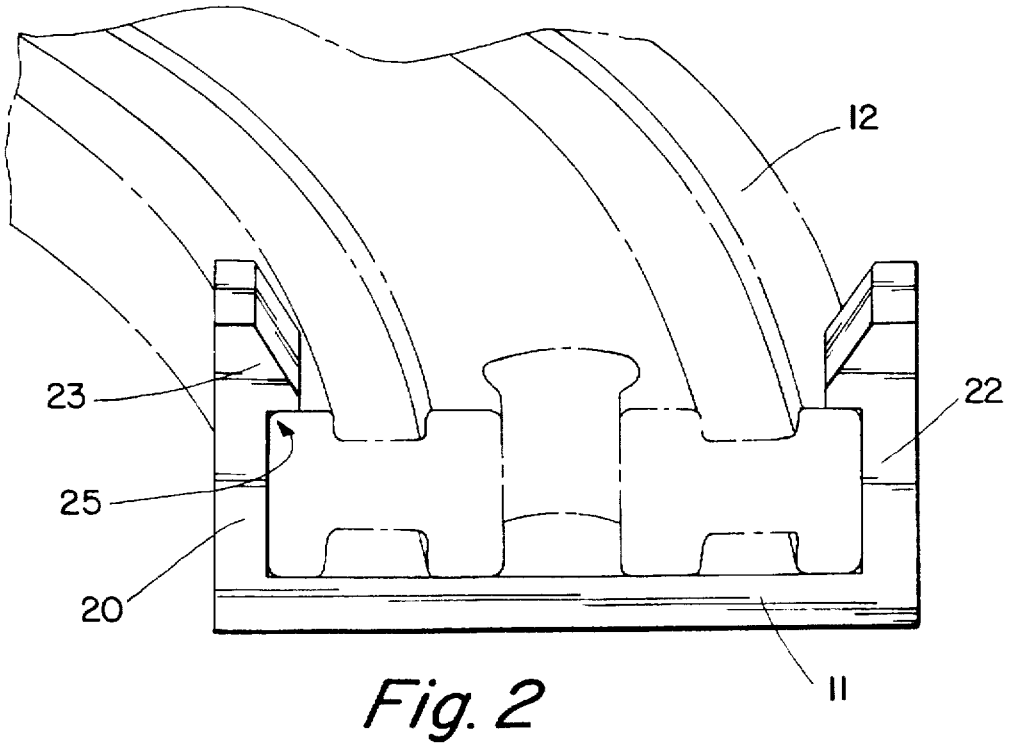
FIG. 2 is a cross sectional view of a connecting clamp of the present invention on a track.
Figure 3:
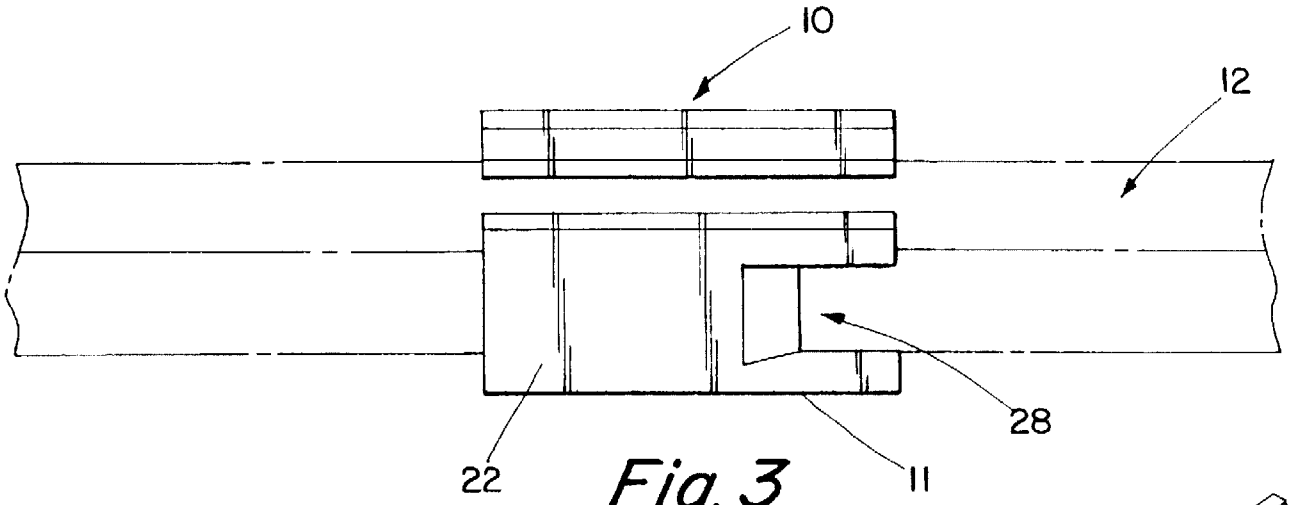
FIG. 3 is a side elevation view of a connecting clamp connecting two track sections.
Figure 4:
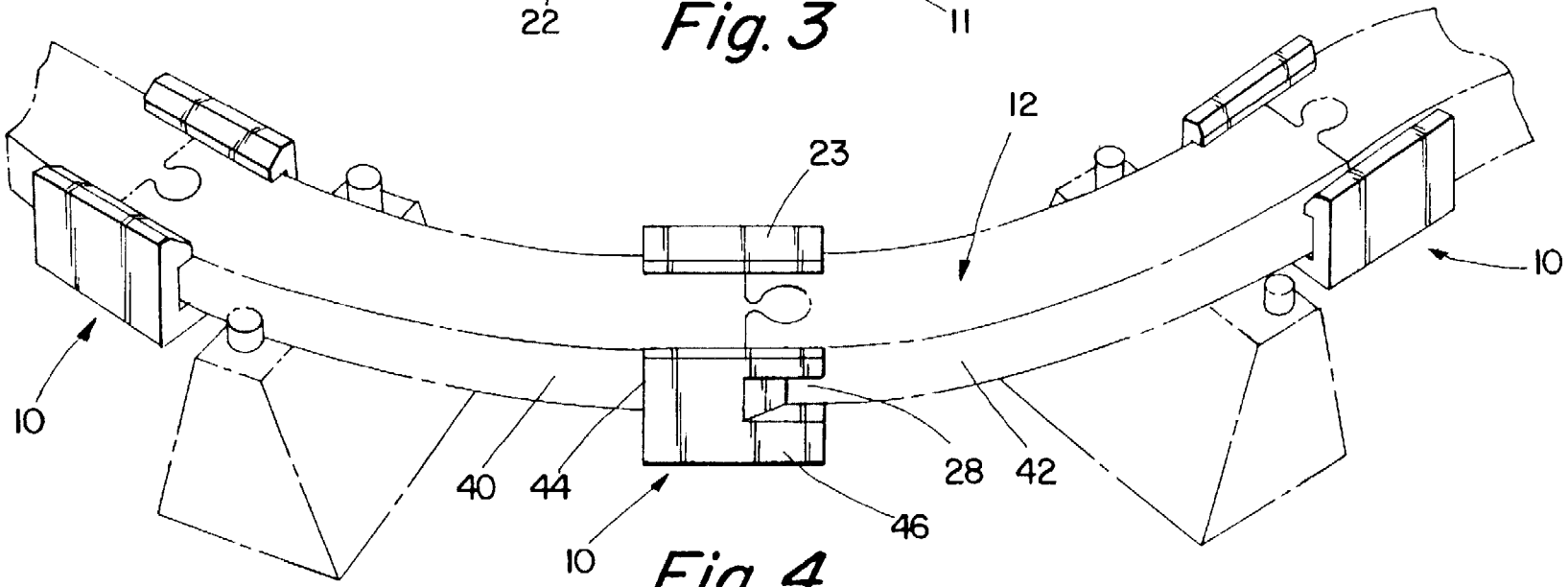
FIG. 4 is an aerial perspective view of the track connector shown in FIG. 1 showing how the connector applied to elevated track sections.
Figure 5:
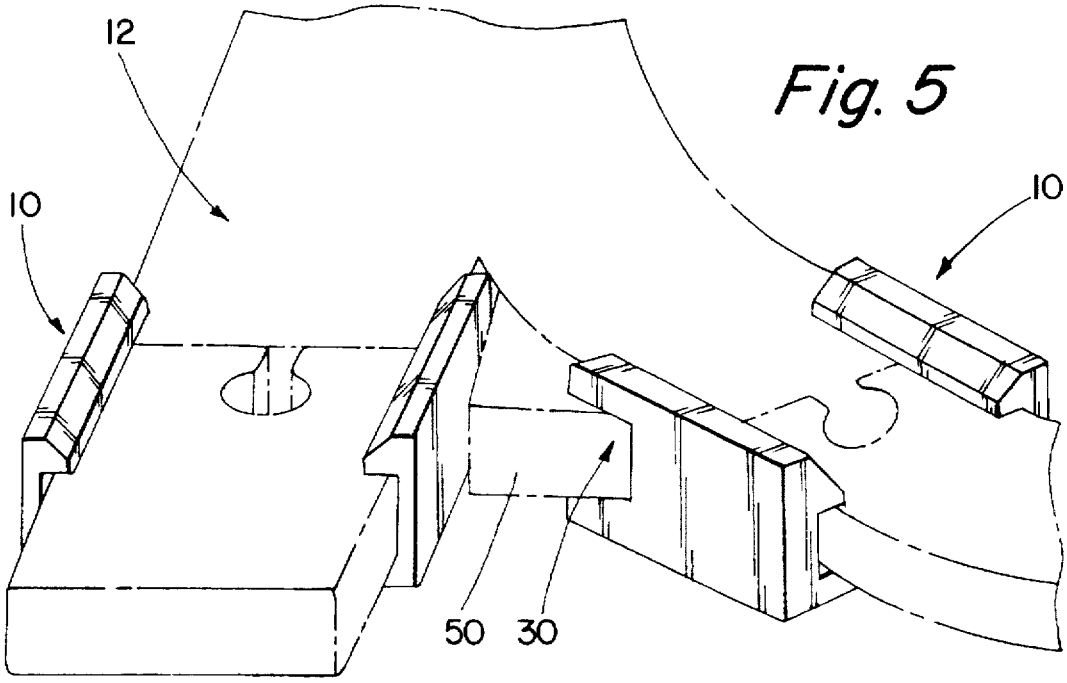
FIG. 5 is a perspective view of the track connector shown in FIG. 1 adjoining curved switching tracks by means of the notched side (as shown in FIG. 3) of the track connector.

Referring now more particularly to the drawings, and specifically to FIGS. 1–5 thereof, a connector of the present invention is generally designated at 10, and may advantageously be fabricated from a material such as plastic, wood, rubber or other suitable materials. The connector may be extruded, made in an injection molding machine, or made using any one or more other well known manufacturing techniques available to those of ordinary skill in the art. The connector 10 includes a base 11.

Upstanding along each longitudinal side edge of the connector base 11 are arms 20 and 22 which rise in a perpendicular direction or may be slightly angled inward from the connector base 11. The slight inward angle of the arms 20, 22 (see FIG. 1) allows the track member 10 to secure different size tracks 12. For example, some tracks 12 have smaller lateral widths with respect to other tracks 12. Accordingly, the sloping angles of the arms 20, 22 will retain smaller tracks 12 while expanding outwardly for tracks with greater widths. Additionally, the inwardly sloped arms 20, 22 also help retain tracks 12 that have curved track portions. The upper edge of each arm 20, 22 preferably slopes at an angle downward toward base 11 to form lips 21, 23. The downward angle which forms lips 21, 23 allows for easy outward expansion of arms 20, 22 as connector is slipped/snapped onto track from below. Said angle also alleviates the possibility of connector providing an obstacle for train wheels. The lower edge of each lip 21, 23 projects a small distance away from its respective arm, forming a cove 25 under each lip.

The dimensions of each connector are established by the size of the track 12 to which it will be used. The connector is sized to fit under the track and closely reside at the outside surface of each side of the track.

The top edge of each side of the track will fit inside the cove 25 of each lip 21, 23, as arms 20, 22 reside adjacent each side of the track. The connector preferably snaps in place onto the track at a location where two track sections 40,42 are connected. One end 44 of the connector resides about one track section 40 while the other end 46 of the connector resides about the second connected track section 42. The connector preferably fits tightly to the track so as not to easily fall off, but not so tightly that it cannot be removed from the track by hand. The connector can be used in several track configurations as shown in the drawings.

In another embodiment of the present invention a notch 28, 30 may be formed in a portion of one or both arms 20, 22. The notch 28, 30 is useful in situations where adjoining track sections have protrusions 50 which would otherwise prevent the connector from fitting one or both sides of a track section. The notch 28, 30 allows the connector to pass around the protrusion and still connect the two track sections.

Having shown and described a preferred embodiment of the invention, those skilled in the art will realize that many variations and modifications may be made to affect the described invention and still be within the scope of the claimed invention. Thus, many of the elements indicated above may be altered or replaced by different elements which will provide the same result and fall within the spirit of the claimed invention. It is the intention, therefore, to limit the invention only as indicated by the scope of the claims.

What is claimed is:

1. A track connector for securing a first track with a second track, comprising:

a base portion;

a first arm upstanding along a first side of said base portion, said first arm portion extending a distance away from said base sufficient to contact a top portion of said first track;

a second distinct arm upstanding along a second side of said base portion, said second arm extending away from said base a distance sufficient to contact a top portion of said second track; and wherein said first and second arm engage and secure said first track with said second track.

2. A track connector according to claim 1, wherein said first and second arm contain notches.

3. A track connector according to claim 1, wherein said first and second arm may expand outwardly as said tracks are slipped into said track connector.

4. A track connector according to claim 1, wherein said base portion, said first arm, and said second arm are made from a resilient, flexible material.

5. A track connector according to claim 1, wherein said first and second arms are slightly angled inward for accommodating different size tracks and curved tracks.

6. A track connector for securing a first track with a second track, comprising:

a base portion;

a first arm portion upstanding along a first side of said base portion;

a second arm portion upstanding along a second side of said base portion;

wherein said first and second arm portions engage and secure said first track with said second track, wherein said first and second arm portions may expand outwardly as said tracks are slipped into said track connector, wherein said first arm portion has a first lip portion which slopes inwardly at an angle for actuating outward expansion of said first arm portion as said first and second tracks are being slipped into said track connector; and wherein said second arm portion has a second lip portion which slopes inwardly at an angle for actuating outward expansion of said second arm portion as said first and second tracks are being slipped into said track connector.

7. A track connector according to claim 3, wherein:

said first lip portion defines a cove portion between said first lip portion and said first arm portion; and said second lip portion defines a cove portion between said second lip portion and said second arm portion.

8. A track connector for securing a first track with a second track, comprising:

a base portion;

a first arm portion upstanding along a first side of said base portion;

a second arm portion upstanding along a second side of said base portion;

wherein said first and second arm portion engage and secure said first track with said second track;

wherein said first and second arm portions contain notches;

wherein said first and second arm portions may expand outwardly as the tracks are slipped into said track connector;

wherein said first arm portion has a first lip portion which slopes inwardly at an angle for actuating outward expansion of said first arm portion as said first track is being slipped into said track connector;

wherein said second arm portion has a second lip portion which slopes inwardly at an angle for actuating outward expansion of said second arm portion as said first track is being slipped into said track connector;

wherein said first lip portion defines a cove portion between said first lip portion and said first arm portion;

wherein said second lip portion defines a cove portion between said second lip portion and said second arm portion;

wherein said base portion, said first arm portion, and said second arm portion is made from a resilient, flexible material; and wherein said first and second arm portions are slightly angled inward for accommodating different size tracks and curved tracks.

* * * * *

UNITED STATES PATENT AND TRADEMARK OFFICE

CERTIFICATE OF CORRECTION

PATENT NO. : 5,779,145

DATED : July 14, 1998

INVENTOR(S) : David A. Zelle and Jill J. T. Zelle

It is certified that error appears in the above-identified patent and that said Letters Patent is hereby corrected as shown below:

In column 3, line 39, please delete the word "portion".

In column 3, line 46, please delete the word "arm" and replace it with -- arms --.

In column 3, line 49, please delete the word "arm" and replace it with -- arms --.

In column 3, line 51, please delete the word "arm" and replace it with -- arms --.

In column 4, line 19, please delete the number "3" and replace it with – 6 --.

Signed and Sealed this

Fifteenth Day of December, 1998

Bruce Lehman

*Attest:*

BRUCE LEHMAN

*Attesting Officer*

*Commissioner of Patents and Trademarks*